United States Patent [19]

Clawson

[11] 4,420,943

[45] Dec. 20, 1983

[54] METHOD AND APPARATUS FOR REFRIGERATOR DEFROST

[75] Inventor: Lawrence G. Clawson, Dover, Mass.

[73] Assignee: Raytheon Company, Lexington, Mass.

[21] Appl. No.: 376,886

[22] Filed: May 10, 1982

[51] Int. Cl.[3] ..... F25B 41/00

[52] U.S. Cl. ..... 62/81; 62/277; 62/149

[58] Field of Search ..... 62/80, 81, 149, 277, 62/278, 174

[56] References Cited

U.S. PATENT DOCUMENTS

| | | | |
|---|---|---|---|
| 3,064,445 | 11/1962 | Gerteis | 62/509 X |
| 3,343,375 | 9/1967 | Quick | 62/81 |
| 3,736,763 | 6/1973 | Garland | 62/174 X |

*Primary Examiner*—Albert J. Makay

*Assistant Examiner*—Henry Bennett

*Attorney, Agent, or Firm*—William R. Clark; Joseph D. Pannone

[57] ABSTRACT

A method and apparatus for defrosting or removing ice from the outside of the evaporator of a refrigerator or heat pump. An additional inventory of refrigerant in thermal communication with a thermal mass is pressurized to substantially the same pressure as the condenser. After the compressor is deactivated at the end of a cooling cycle, a valve separating the inventory and evaporator is opened whereby the respective pressures rapidly equalize to an intermediate pressure. The inventory of refrigerant boils in the reduced pressure thereby drawing heat from the thermal mass to support the process. The vaporized refrigerant flows through the valve to the evaporator and condenses in the relatively cool environment. The heat given off by the condensation process melts ice on the outside of the evaporator.

15 Claims, 2 Drawing Figures

METHOD AND APPARATUS FOR REFRIGERATOR DEFROST

BACKGROUND OF THE INVENTION

The typical refrigerator or heat pump includes an evaporator, a compressor, a condenser, and an expansion valve or capillary tube. As is well known, the working fluid which is referred to as the refrigerant goes through a thermodynamic cycle. The refrigerant leaves the compressor as a vapor at an elevated pressure and then condenses resulting in the transfer of heat to cooling water or fins surrounding the condenser. The high pressure liquid passes through an expansion valve or capillary tube where some of the liquid flashes into vapor. The remaining fluid is vaporized in the low pressure evaporator resulting in the transfer of heat from the refrigerated volume. This vapor then enters the compresser and the cycle begins again. In short, in the evaporator, the refrigerant absorbs heat from the surroundings and, in the condenser, it gives heat off. During the cooling cycle, ice builds up on the coils and fins of the evaporator because the temperature of the evaporator is substantially below the freezing point of water. As is well known, this ice substantially reduces the coefficient of performance of the system. More specifically, the ice acts as an insulator and provides a thermal barrier that interferes with the thermal transfer to the evaporator. Accordingly, the compresser has to work harder and/or longer to provide the required thermodynamic cycle. Also, energy is lost to heat of solidification in forming the ice.

There are two common prior art approaches to removing ice from the evaporator automatically. Both approaches require the expenditure of substantial amounts of energy. The first approach which is used extensively for automatic defrosting refrigerators involves the use of heat from an external source to melt the ice. Typically, a resistive heating element is connected to the evaporator or mounted in a position adjacent thereto. Then, in response to a timer, electric current is passed through the element during an off cycle of the compresser. The period for ice to build up on the evaporator is a function of several parameters such as, for example, the season of the year. Typically, however, most automatic defrost refrigerators activate the defrost cycle at a constant interval in the range from 10 to 16 hours. Because a typical defrost heating element may be rated at 1.2 Kw per hour and the average cycle time may be 15 minutes or longer, it is not uncommon for a refrigerator to use up to 1 Kw each day in defrosting the evaporator. This excessive amount of energy is inefficiently used to melt the ice because a substantial percentage of the heat may be radiated into the freezer. Further, this defrosting energy does not include the energy required to cool the evaporator and freezer back down to the steady state operating condition. It follows that the use of an external heat source to defrost the evaporator may significantly reduce the coefficient of performance.

The second common prior art approach to defrosting an evaporator is used extensively in relatively large capacity heat pumps. A four-way valve is employed in conjunction with the compressor so that during the defrost cycle, the direction of flow of the refrigerant can be reversed. In essence, the evaporator becomes the condenser and the condenser becomes the evaporator. As described earlier herein, heat is given off in the condenser stage of the cycle and this heat is used to melt the ice. One draw back of this defrosting approach is the initial cost of the four-way valve and controls. Also, although this approach utilizes less energy than operating a heating element, some energy is expended driving the compressor during the reverse operation of the defrost cycle.

SUMMARY OF THE INVENTION

The invention discloses a refrigeration system comprising an evaporator, a condenser, a reservoir for holding refrigerant, a compressor having its input coupled to the evaporator and its output coupled in parallel to the condenser and the reservoir wherein, during a steady state cooling cycle when the compressor is activated, the compressor pumps refrigerant from the evaporator to the condenser and reservoir to provide a first pressure in the condenser and the reservoir and a second pressure in the evaporator, the first pressure being substantially higher than the second pressure, a capillary connecting the condenser to the evaporator for completing the refrigerant cooling cycle loop, a thermal mass thermally coupled to the reservoir, and means for opening a passage between the reservoir and the evaporator to equalize the pressures in the reservoir and the evaporator at an intermediate pressure between the first and second pressures wherein refrigerant evaporates in the reservoir, flows through the passage and condenses in the evaporator, the condensing providing heat to melt ice off the outside of the evaporator. Preferably, the capillary may comprise a conventional capillary tube or an expansion valve. The thermal mass may comprise a jacket or liquid such as water surrounding the reservoir. Also, the mass may comprise a metallic body. The opening means may preferably comprise a solenoid operated valve and the solenoid may be activated by a timer. The time period for the pressures to equalize may preferably be on the order of a few seconds.

The invention may be practiced by a refrigeration system comprising an evaporator, a condenser, a compressor coupled between the evaporator and the condenser for pumping refrigerant from the evaporator to the condenser during a cooling cycle to provide a first pressure in the condenser and a second pressure in the evaporator, the first pressure being substantially higher than the second pressure, a first passage of restricted cross-sectional area from the condenser to the evaporator for completing the refrigerant cooling cycle loop, means for providing heat to the evaporator to remove ice on the outside thereof, the means comprising a second passage between the condenser and the evaporator, the second passage having a valve wherein the pressures in the condenser and the evaporator equalize at an intermediate pressure between the first and second pressures when the valve is opened, and the means further comprising a reservoir coupled to the condenser for holding refrigerant, the reservoir being in thermal communication with a thermal mass wherein, when the valve is opened heat is lost by the thermal mass and gained by the evaporator by the respective processes of refrigerant evaporating in the reservoir and then condensing in the relatively cool evaporator after flowing through the second passage. It may be preferable that the first pressure be greater than 125 PSIG and the second pressure less than 25 PSIG.

The invention teaches a refrigeration system comprising an evaporator, a condenser, a reservoir for holding refrigerant, a compressor for pumping refrigerant from the evaporator to the condenser and through a check valve to the reservoir wherein a first pressure is provided in the condenser and the reservoir and a second pressure is provided in the evaporator, the first pressure being substantially higher than the second pressure, a thermal mass thermally coupled to the reservoir, a capillary connecting the condenser to the evaporator for completing the refrigerant cooling cycle loop and a valve controlled passage from the reservoir to the evaporator wherein the opening of the passage substantially equalizes the pressure in the reservoir and the evaporator at an intermediate pressure between the first and second pressures, the thermal mass providing heat to support boiling of the refrigerant in the reservoir and the evaporator being heated by condensing of the refrigerant therein to melt ice on the outside thereof.

In a refrigeration system comprising an evaporator, compressor, condenser, and capillary from the condenser to the evaporator wherein the operating pressure of the condenser is substantially higher than the evaporator, the method of removing ice built up on the outside of the evaporator, comprising the steps of providing an inventory of refrigerant thermally coupled to a thermal mass, pressurizing the inventory at substantially the same pressure as the condenser during a steady state cooling cycle, deactivating the compressor, and opening a passage between the inventory and the evaporator to equalize the pressure wherein heat is transferred from the thermal mass to support evaporation of the inventory and heat is given off by the evaporated refrigerant condensing in the evaporator.

In a refrigeration system comprising an evaporator, compressor, condenser, and capillary from the condenser to the evaporator, wherein the operating pressure in the condenser is substantially higher than the evaporator, the method of removing ice from the outside of the evaporator, comprising the steps of providing a refrigerant inventory having a thermal mass thermally coupled therewith, pressurizing said inventory at the approximate steady state cooling cycle pressure of the condenser, opening a passage between the inventory and the evaporator wherein the pressure differential between the inventory and the evaporator is rapidly reduced, transferring heat from the thermal mass to support refrigerant evaporation in the reduced pressure of the condenser, flowing the vapor of the evaporation to the evaporator through the passage, and condensing the vapor in a relatively cool evaporator to provide heat to remove the ice. It may preferable that the term rapidly with reference to pressure equalization define a time period of a few seconds or less.

BRIEF DESCRIPTION OF THE DRAWINGS

The foregoing objects and advantages of the invention will be more apparent from the Description of the Preferred Embodiment with reference to the drawings wherein.

DESCRIPTION OF THE PREFERRED EMBODIMENT

Figure 1:
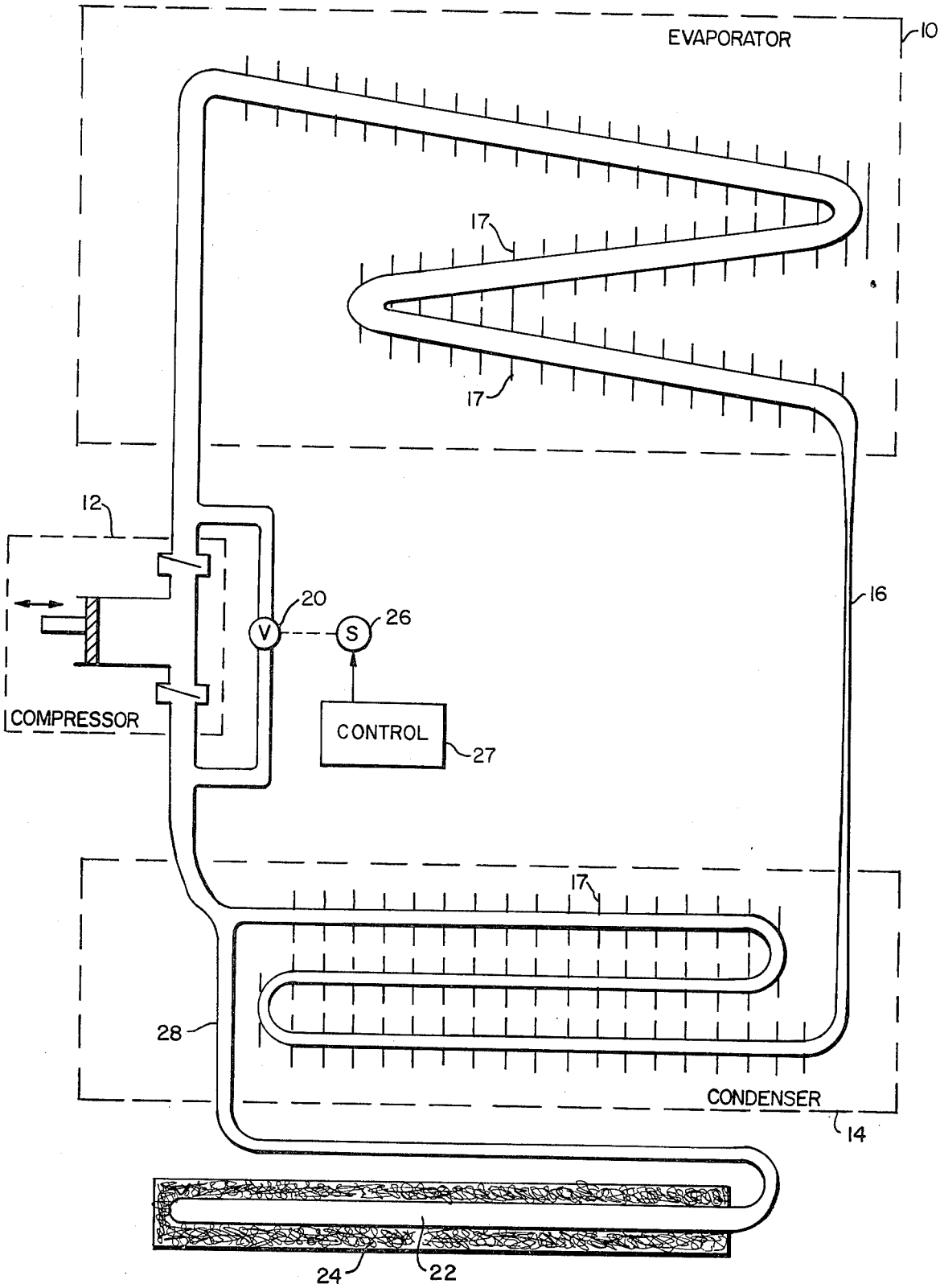
FIG. 1 is a diagram of a refrigeration or heat pump system embodying the invention.

Referring to FIG. 1, there is shown a refrigerator or heat pump embodying the invention to advantage. The conventional four basic elements of a refrigerator are evaporator 10, compressor 12, condenser 14, and capillary tube 16. In a conventional alternate embodiment, an expansion valve could be used in place capillary tube 16. During the cooling cycle, these four basic elements operate in a conventional manner as is well known in the art. More specifically, the closed loop system contains a refrigerant fluid such as, for example, Freon or ammonia, which goes through a thermodynamic cycle. Compressor 12 pumps the refrigerant in a counterclockwise direction through the loop as shown in FIG. 1. The constricted cross-sectional area of capillary tube 16 creates a relatively high pressure in condenser 14 and a relatively low pressure in evaporator 10. More specifically, the condenser may preferably be operated in the steady state cooling cycle at a pressure of approximately 160 PSIG and a temperature of 122° F. Also, by the compressor suction working against the capillary restriction, evaporator 10 may preferably be operated at an a pressure of approximately 9 PSIG and a temperature of 0° F. The invention is described with reference to the above set of operating conditions which may be optimum for a particular refrigerant and a particular refrigerator system. However, it will be apparent to those skilled in the art that the conditions are for illustration only and that the inventive concept can be used to advantage with many other sets of operating conditions and with a variety of cooling systems. As is well known, the relatively high temperature of the condenser results from the refrigerant giving off heat as the vapor entering from the compressor condenses in the high pressure region. Also, the relatively low temperature of the evaporator results from the refrigerant absorbing heat as the liquid entering from the capillary tube vaporizes. Fins 17 are used to provide more rapid transfer of heat to the evaporator and from the condenser.

In a conventional prior art refrigerator, the compressor seals and functions as a shut valve when the compressor is deactivated at the end of a cooling cycle. Because the pressure in the condenser is high compared to the pressure in the evaporator, fluid continues to flow from the condenser through the capillary tube to the evaporator without any energy being added to the system. As the differential pressure between the condenser and the evaporator reduces, the rate of flow decreases until the respective pressures equalize and the flow ceases. During this pressure equalization process, all liquid refrigerant in the condenser flashes as the pressure in the condenser decreases. As the remaining vapor enters the cool evaporator during the pressure equalization process, a certain amount of condensation does occurs. Accordingly, there is some thermal transfer from the condenser to the evaporator caused by this small condensation. However, in a conventional refrigerator, the volume of the condenser is usually significantly smaller than the evaporator and the inventory of refrigerant is not large enough to provide enough condensation thermal transfer to defrost the evaporator. Furthermore, the pressure equalization process takes a substantialy amount of time so that any heat transfer is very slow; in a typical refrigerator, it may take on the order of 5–15 minutes for the pressures to equalize.

Accordingly, as described in the Background herein, prior art refrigerators generally require an external heat source such as a resistive heating element or convected hot air to defrost the coils and fins of the evaporator.

In accordance with the invention and as shown in FIG. 1, a compressor by-pass valve 20, a reservoir 22 with a relatively large inventory of refrigerant, and a thermal mass 24 are added to the conventional refrigerator. As described earlier herein, the invention operates identical to prior art refrigerators during the cooling cycle. However, at the end of a cooling cycle when the compressor is deactivated, by-pass valve 20 is opened by solenoid 26. With the by-pass valve open, the pressures of the evaporator and condenser/reservoir equalize in a short period of time such as, for example, a few seconds or less. Whereas the respective pressures in the condenser/reservoir and evaporator before the by-pass valve is opened may be 160 and 9 PSIG, both rapidly arrive at an equalized intermediate pressure such as, for example, 60 PSIG. The superheated condenser refrigerant at the illustrative temperature of 122° F. and reservoir 22 refrigerant at room temperature begin to rapidly boil as the pressure in the condenser and reservoir drops from 160 PSIG to 60 PSIG. As the vaporized refrigerant flows through by-pass valve 20 to the evaporator, it is subjected to the supercooled walls and therefore it condenses. In other words, the combination of a pressure of 60 PSIG and a temperature of 122° F. in the condenser or room temperature in the reservoir can not support the refrigerant as a liquid and it rapidly evaporates or boils. Also, the combination of a pressure of 60 PSIG and temperature of 0° F. in the evaporator can not support the refrigerant as a vapor and it rapidly condenses. Accordingly, there is substantial heat transfer from the condenser and the reservoir to the evaporator caused by the respective evaporation and condensation processes. There are three important differences between the inventive pressure equalization process and that of conventional refrigerators. First, the flow of heat is very rapid because the pressure equalization is not restricted by the conventional capillary tube or expansion valve. Second, the inventory of refrigerant is much larger so that substantially more vapor and heat flows to the evaporator before the system finally approaches stabilization. And third, thermal mass 24 provides a source of heat to be transferred. More specifically, thermal mass 24 reduces the rate that the temperature of the liquid refrigerant in reservoir 22 decreases as a result of evaporation. Accordingly, the refrigerant boils faster and longer than it would without the thermal mass. Summarizing the thermodynamic process, heat is transferred from the thermal mass to support the refrigerant boiling in the reservoir and heat is given off in the evaporator caused by the refrigerant vapors condensing in the relatively cool environment therein.

Although the components in accordance with the invention can be defined by a variety of embodiments, an operative embodiment will be described as an example. For a standard sized refrigerator, reservoir 22 which is part of the closed system refrigerator loop, may preferably be a three inch diameter cylinder that is eight inches long. Accordingly, reservoir 22 may hold approximately one liter of additional liquid refrigerant. It may be preferable that three pounds of refrigerant be provided for each pound of ice that is to be melted during defrost. During start up of a cooling cycle, refrigerant condenses in reservoir 22. Then, after reservoir 22 is substantially filled with liquid, there will be no more condensing in the reservoir. Accordingly, the temperature of the refrigerant in reservoir 22 and thermal mass 24 will decrease heading for the temperature of the surroundings. Accordingly, the temperature of reservoir 22 and thermal mass 24 may eventually approximate room temperature which typically may be in the range from 65° F. to 90° F. A variety of embodiments may be used for thermal mass 24; a cost effective embodiment is a five inch diameter water jacket encasing reservoir 22. Various minerals may be disolved in the water to increase its thermal storing capacity and/or its thermal conductivity. During the defrost cycle, heat transfers from the water to support the evaporation of the refrigerant in the reservoir thus lowering the temperature of the water to a level below its initial temperature which may be room temperature. Then, the heat may be replaced to the water from its room temperature surroundings over an extended period of time. One way of viewing the invention is a heat pipe that rapidly transfers heat from a room temperature mass wherein the mass is then permitted to absorb heat to return to room temperature over a long period of time.

As described, heat is given off to evaporator 10 during the defrost cycle by the process of the refrigerant condensing therein. It has been found that in accordance with the invention, this heat is sufficient to completely defrost the evaporator. In fact, as the heat is transferred to the coils and fins of the evaporator, chunks of ice may start falling off in just a matter of 10 or 15 seconds. Then, within just a few more seconds, the evaporator is completely defrosted. The time for defrost will generally depend on such factors as the weight of the ice, the inventory of refrigerant, and the initial temperature of the thermal mass. During the first part of the defrost cycle, the ice or frost serves as a heatsink to support the condensation within the evaporator. After the ice is removed from the evaporator, however, this heatsink is lost and the evaporator can not support such rapid condensation. Accordingly, it is believed that the rate of flow of heat to the evaporator substantially reduces after the ice or frost is removed. This self-limiting phenomenon is advantageous to the coefficient of performance of the system embodying the inventive principle because only enough energy as approximately required for the defrost is transferred to the evaporator. Accordingly, less energy is required to reinitiate the steady state cooling cycle. Stated in other words, the number of BTUs required to defrost the evaporator are rapidly transferred and then the rate of transfer substantially decreases. For a particular system, valve 20 can be closed at a specified time period into the defrost cycle to prevent further transfer of heat through the valve passage. It is advantageous that the heat that is transferred to the evaporator is substantially used to melt ice rather than being inefficiently radiated into the freezer as is done with an electric heating element.

In a conventional refrigerator using a resistive heating element for defrosting, energy is used to heat the element and then more energy is used to return the evaporator and its environment to its operating temperature. Although no energy is used in accordance with the invention in the defrost process, compressor 12 energy is required to return the system to the cooling cycle. More specifically, the reservoir and condenser must be returned to the relatively high operating pressure resulting in refrigerant condensing therein. However, it has been found that this required energy is substantially less than the total defrost energy expended in prior art systems. During the defrost process, heat is transferred from thermal mass 24 so that the temperature of the thermal mass drops, for example, from a room temperature of approximately 70° F. to 50° F. Accordingly, in reinitiating the cooling steady state condition, the compressor is operating against a lower pressure and temperature than in the steady state condition. Accordingly, less energy is expended to operate the compressor.

In the embodiment of FIG. 1, reservoir 22 communicates directly with condenser 14 through tube 28. Accordingly, refrigerant will flow from one to the other to maintain equalized pressures therein. In fact, in this embodiment, reservoir 22 holding an additional inventory of refrigerant and thermal mass 24 may be physically embodied as part of condenser 14. In some applications, it may be preferable that control 27 provide a signal to solenoid 26 so that valve 20 is opened any time compressor 12 is not activated. An example of such an application is a refrigerator wherein the compressor is activated substantially all the time and its speed is regulated to control the degree of cooling. In such an application, the compressor in response to a timer could be periodically deactivated for a defrost cycle on the order of 10 or 15 minutes. Preferably, the control signal from control 27 to solenoid 26 would be the compliment of the activation signal for the compressor. In other common systems wherein the compressor is frequently deactivated, the system described above may initiate the defrost process more frequently than is necessary or desirable. Accordingly, an alternate embodiment will be described later herein.

Figure 2:
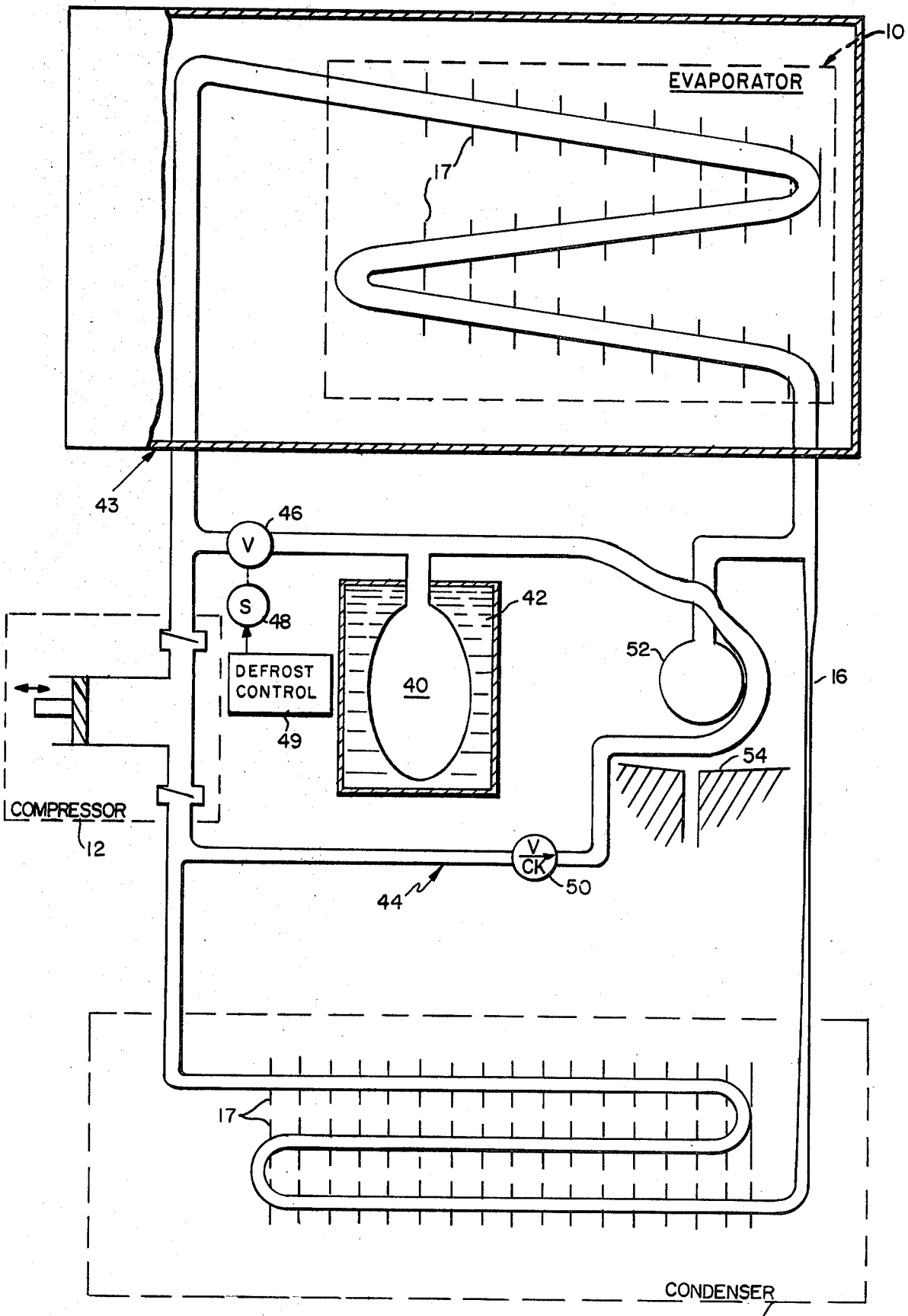
FIG. 2 is an alternate embodiment of the system of FIG. 1.

Referring to FIG. 2, an alternate embodiment of the system of FIG. 1 is shown. As with the refrigerator in FIG. 1, evaporator 10, compressor 12, condenser 14, and capillary tube 16 function as they do in conventional refrigerators or heat pumps. The evaporator is shown positioned in a conventional freezer or refrigerator compartment 43. Reservoir 40 and thermal mass 42 are positioned in a by-pass loop 44 of compressor 12. Thermal mass 42, as shown, is a liquid jacket surrounding reservoir 40. Similar to valve 20 and solenoid 26 of FIG. 1, valve 46 is opened by solenoid 48 to initiate the defrost cycle. Unlike FIG. 1, however, check valve 50 in by-pass loop 44 prevents the flow of refrigerant from reservoir 40 to condenser 14. Accordingly, refrigerant vapor from reservoir 40 only participates in the defrost process when valve 46 is open. More specifically, unlike FIG. 1 where refrigerant vapor from reservoir 22 will eventually pass through condenser 14 and capillary tube 16 into evaporator 10 during the slow pressure equalization process any time the compressor is deactivated, check valve 50 maintains reservoir 40 at a high pressure unless valve 46 is opened. Accordingly, the use of reservoir 40 and thermal mass 42 in defrosting is entirely controlled by defrost control 49 that is used to activate solenoid 48; no refrigerant vapor will leak from reservoir 40 through capillary 16.

Defrost control 49 may preferably be a conventional defrost circuit. More specifically, a timer identical to ones used to energize prior art resistive heating elements can be used to activate solenoid 48 at periodic intervals such as, for example, once every 10 to 16 hours. As with conventional defrost systems, the solenoid would typically be activated at the end of a cooling cycle after compressor 12 has been deactivated. In an alternate embodiment, defrost control 49 can be coupled to a sensor (not shown) which senses the build up of ice on the evaporator coils and fins. Accordingly, the defrost cycle would only be initiated when required. This may be preferable because the number of hours to build up ice which requires defrosting varies as a function of such factors as the humidity in environmental air, temperature of the environment, temperature of the evaporator, and frequency of opening the refrigerator door. Because a standard timer circuit does not compensate for changes in these factors, its defrost cycle would be initiated more frequently than required thus reducing the coefficient of performance by expending the additional compressor energy required to start up the system after defrosting. It may be preferable that defrost control 49 deactivate solenoid 48 to close valve 46 shortly after a defrost cycle begins so that the amount of heat which flows is limited to that which is approximately necessary to defrost the evaporator. This time period will depend on system parameters.

Liquid accumulator 52 facilitates the condensation of more refrigerant in the evaporator so as to provide more thermal transfer to the evaporator from the condenser. Also as shown in FIG. 2, the heat being transferred from the condenser and/or reservoir may be used for auxiliary functions such as melting ice that has dropped off evaporator 10 or accumulator 52 so that it can flow away through drain 54. Another function for the heat flow may be to heat the surfaces around the doors so as to eliminate the accumulation of ice which would prevent the closing of the refrigerator door. Also, the heat could be used in an automatic ice maker to melt the ice cube surface area contacting the container.

This concludes the Description of the Preferred Embodiment. However, from the reading of it, many modifications and alterations will be apparent to one skilled in the art without departing from the spirt and scope of the invention. For example, the fluid capacity of the reservoir, the amount of additional refrigerant and the thermal capacity of thermal mass may be optimized for the particular refrigerator or heat pump system. Accordingly, it is intented that the scope of the invention only be limited by the appended claims.

What is claimed is:

1. A refrigeration system comprising:

an evaporator;

a condenser;

a reservoir for holding refrigerant;

a compressor having its input coupled to said evaporator and its output coupled in parallel to said condenser and said reservoir wherein, during a steady state cooling cycle when said compressor is activated, said compressor pumps refrigerant from said evaporator to said condenser and said reservoir to provide a first pressure in said condenser and said reservoir and a second pressure in said evaporator, said first pressure being substantially higher than said second pressure;

a capillary connecting said condenser to said evaporator for completing the refrigerant cooling cycle loop;

a thermal mass thermally coupled to said reservoir;

means for deactivating said compressor and for opening a passage wherein the pressure at the input to said compressor is rapidly equalized with the pressure at the outlet of said compressor at an intermediate pressure between said first and second pressures wherein said refrigerant evaporates in said reservoir, flows through said passage, and condenses in said evaporator, said condensing providing heat to melt ice off the outside of said evaporator; and the heat for continued evaporation of said refrigerant in said reservoir being provided from said thermal mass.

2. The system recited in claim 1 wherein said capillary comprises an expansion valve.

3. The system recited in claim 1 wherein said thermal mass comprises a jacket of liquid surrounding said reservoir.

4. The system recited in claim 1 wherein said opening means comprises a solenoid operated valve.

5. The system recited in claim 4 further comprising a timer connected to said solenoid.

6. A refrigeration system comprising:

an evaporator;

a condenser;

a compressor coupled between said evaporator and said condenser for pumping refrigerant from said evaporator to said condenser during a cooling cycle to provide a first pressure in said condenser and a second pressure in said evaporator, said first pressure being substantially higher than said second pressure;

a first passage of restricted cross-sectional area from said condenser to said evaporator for completing the refrigerant cooling cycle loop;

means for providing heat to said evaporator to remove ice on the outside thereof, said means comprising a second passage between said condenser and said evaporator, said second passage having a valve which is opened after said compressor is deactivated wherein the pressure at the input to said compressor is rapidly equalized with the pressure at the outlet of said compressor at an intermediate pressure between said first and second pressures; and said means further comprising a reservoir coupled to said condenser for holding refrigerant, said reservoir being in thermal communication with a thermal mass wherein, when said valve is opened, heat is lost by said thermal mass and gained by said evaporator by the respective processes of refrigerant evaporating in said reservoir and then condensing in said relatively cool evaporator after flowing through said second passage.

7. The system recited in claim 6 wherein said thermal mass comprises a jacket of liquid surrounding said reservoir.

8. The system recited in claim 6 wherein said thermal mass comprises a metallic body contacting said reservoir.

9. The system recited in claim 6 further comprising a solenoid for opening said valve.

10. The system recited in claim 6 wherein said first pressure is greater than 125 PSIG and said second pressure is less than 25 PSIG.

11. A refrigeration system comprising:

an evaporator;

a condenser;

a reservoir for holding refrigerant;

a compressor for pumping refrigerant from said evaporator to said condenser and through a check valve to said reservoir wherein a first pressure is provided in said condenser and said reservoir and a second pressure is provided in said evaporator, said first pressure being substantially higher than said second pressure;

a thermal mass thermally coupled to said reservoir;

a capillary connecting said condenser to said evaporator for completing the refrigerant cooling cycle loop; and a valve-controlled passage from said reservoir to said evaporator wherein the opening of said passage after said compressor is deactivated substantially equalizes the pressure across said compressor and in said reservoir and said evaporator at an intermediate pressure between said first and second pressures, said thermal mass providing heat to support boiling of said refrigerant in said reservoir and said evaporator being heated by condensing of said refrigerant therein to melt ice on the outside thereof.

12. The system recited in claim 11 wherein said thermal mass comprises liquid surrounding said reservoir.

13. The system recited in claim 11 wherein said valve is operated by a solenoid.

14. In a refrigeration system comprising an evaporator, compressor, condenser, and capillary from said condenser to said evaporator wherein the operating pressure of said condenser is substantially higher than said evaporator, the method of removing ice built up on the outside of said evaporator, comprising the steps of:

providing an inventory of refrigerant thermally coupled to a thermal mass;

pressurizing said inventory at substantially the same pressure as said condenser during a steady state cooling cycle;

deactivating said compressor; and opening a passage wherein the pressure at the two sides of said compressor are rapidly equalized and wherein heat is transferred from said thermal mass to support evaporation of said inventory and heat is given off by said evaporated refrigerant condensing in said evaporator.

15. In a refrigeration system comprising an evaporator, compressor, condenser, and capillary from said condenser to said evaporator, wherein the operating pressure in the condenser is substantially higher than the evaporator, the method of removing ice from the outside of said evaporator, comprising the steps of:

providing a refrigerant inventory having a thermal mass thermally coupled therewith;

pressurizing said inventory at the approximate steady state cooling cycle pressure of said condenser using said compressor;

deactivating said compressor;

opening a passage between the input and outlet of said compressor wherein the pressure differential between said inventory and said evaporator is rapidly reduced;

transferring heat from said thermal mass to support refrigerant evaporation in the reduced pressure of said condenser;

flowing the vapor of said evaporation to said evaporator through said passage; and condensing said vapor in said relatively cool evaporator to provide heat to remove said ice.

* * * * *